US006364104B1

(12) United States Patent
Bertling et al.

(10) Patent No.: US 6,364,104 B1
(45) Date of Patent: Apr. 2, 2002

(54) CAP FOR CONTAINERS

(75) Inventors: Wolf Bertling; Werner Frör, both of Erlangen (DE)

(73) Assignee: november Aktiengesellschaft Gesellschaft fur Molekulare Medizin (DE)

( * ) Notice: Subject to any disclaimer, the term of this patent is extended or adjusted under 35 U.S.C. 154(b) by 0 days.

(21) Appl. No.: 09/622,185

(22) PCT Filed: Feb. 9, 1999

(86) PCT No.: PCT/DE99/00351

§ 371 Date: Sep. 25, 2000

§ 102(e) Date: Sep. 25, 2000

(87) PCT Pub. No.: WO99/41160

PCT Pub. Date: Aug. 19, 1999

(30) Foreign Application Priority Data

Feb. 13, 1998 (DE) ..... 198 05 888

(51) Int. Cl.[7] ..... B65D 25/08
(52) U.S. Cl. ..... 206/222; 206/219
(58) Field of Search ..... 206/219, 222, 206/568; 366/130; 215/DIG. 8; 222/80

(56) References Cited

U.S. PATENT DOCUMENTS 4,387,998 A * 6/1983 Szigeti ..... 366/130
5,543,097 A * 8/1996 Fang ..... 206/222
6,098,795 A * 8/2000 Mollstam et al. ..... 206/222

FOREIGN PATENT DOCUMENTS

DE 37 44 161 7/1989

* cited by examiner

*Primary Examiner*—David T. Fidei
(74) *Attorney, Agent, or Firm*—Fish & Richardson P.C. P.A.

(57) ABSTRACT

The invention refers to a cap for containers for holding a mixture to be produced from two components, having a cylinder (5) with an open end and an end closed by a partition (6) which can be perforated, a piston (1) having a gripping piece (2) of larger design than the cylinder diameter being inserted into the open end of the cylinder, such that a first chamber (K1) having a height (h) is formed between a lower side (KU) of the piston lying opposite the gripping piece (2) and the partition (6), characterized in that two incisions (7) extending from the open end of the cylinder and lying opposite each other are provided in the cylinder wall, and in that the gripping piece (2) is designed in such a manner that it can be displaced in the incisions (7) in order to move the piston (1) in the direction of the partition (6).

19 Claims, 7 Drawing Sheets

CAP FOR CONTAINERS

BACKGROUND OF THE INVENTION

The invention relates to a cap for a container in accordance with the preamble of Claim 1. It furthermore relates to a container according to Claim 14.

A cap of this type is disclosed in DE 27 09 826 C2. The known cap has the disadvantage that the piston provided in the cap is unintentionally pressed in the direction of a container receptacle or receptacle and, as a result, a partition, which separates a first chamber situated in the cap from a second chamber essentially enclosed by the receptacle, is destroyed. A first component held in the first chamber can therefore unintentionally come into contact with a second component held in the second chamber. The mixture produced in the process either hardens rapidly or can only be kept for a short period.

In order to counteract this disadvantage, it is disclosed in EP 0 217 425 to provide the cap with an overcap. The provision of a special overcap is complicated.

Furthermore, a container for separately holding and for mixing two substances is disclosed in CH 485 566. In this case, a cavity provided in a lid is filled with a liquid. The cavity is closed by means of a displaceable stopper which has a capillary hole pointing towards the receptacle. Displacement of this stopper causes the liquid to be pressed through the capillary hole into the receptacle.—If the receptacle contains a dried or hygroscopic powder, liquid penetrates through the capillary hole into the vessel. This may lead to premature compaction or destruction of the powder.

SUMMARY OF THE INVENTION

The object of the present invention is to eliminate the disadvantages of the prior art. The intention, in particular, is to provide a cap for a container for holding a two-component mixture, and a container, which cap/container is of simple construction and by means of which an unintentional bringing of the two components into contact can be avoided.

This object is achieved by the features of Claims 1 and 14. Expedient refinements emerge from the features of Claims 2 to 13 and 15 to 18.

The invention makes provision for two incisions, extending from the open end and lying opposite each other, to be provided in the cylinder wall, and for the gripping piece to be designed in such a manner that it can be displaced in the incisions in order to move the piston in the direction of the partition. As a result, unintentional pressing in of the piston in the direction of the partition can be reliably avoided. The cap can namely only be pressed down if the gripping piece has previously been brought, by rotation, into alignment with the incisions. The proposed cap can be produced in a simple manner.

According to one refinement feature, the height is smaller than or equal to the length of the incisions. This enables the piston to be pressed down until it bears against the partition. Complete emptying of the first chamber is therefore ensured.

The gripping piece can be of plate like design. This facilitates axial rotation of the piston in order to bring the gripping piece into alignment with the incisions.

A means for piercing the partition can be provided on the piston lower side. The means in this case is preferably a lance. However, the means for piercing can also be formed by a beveled piston section.

In order to ensure a particularly good seal between the piston and the cylinder inner wall, a radially encircling, flexible sealing means, such as a sealing lip or an O-ring, can be provided on the piston.

The piston and the gripping piece advantageously have an axial passage. The first chamber can be filled through this duct.

It is of advantage in terms of production to produce the piston in an integral design with the gripping piece and/or the means for piercing and/or the sealing lip from injection-molded plastic.

The gripping piece and the cylinder are expediently connected to a bridge which can be severed and is preferably produced from plastic. The bridge may also be replaced by a stuck-on securing label. It can thereby be ensured in a simple manner that the components held in the chambers correspond to the original components put in by the manufacturer. An unnoticed, subsequent manipulation, for example an exchange of the components, is therefore made impossible.

A radially encircling, flange-like web is preferably provided on the outer wall of the cylinder. The web serves as a stop when inserting the cap into the neck of a cylindrical container. A plurality of grooves running axially can be provided on the outer wall of the cylinder. The grooves are designed in their axial extent in such a manner that with the cylinder pushed completely into the container up to the web, the second chamber is closed in a leaktight manner.

According to a further refinement feature, extensions having latching lugs for engagement in recesses provided on the incisions can be attached to the gripping piece. With the piston pushed completely into the cylinder, the cylinder can therefore be removed from the container by pulling on the gripping piece.

A container having a cap according to the invention is furthermore provided, the container having a receptacle of essentially cylindrical design, and the cap being inserted in a sealing manner into the receptacle, with the result that the partition closes a second chamber formed in the receptacle.

With the container, an unintentional bringing of the substances held in it into contact is reliably avoided. The container can be produced simply and cost-effectively.

The opening edge of the receptacle is advantageously designed in the form of two helical sections placed against each other in each case by means of a shoulder. The pitch of the helical sections or the height of the shoulders is expediently identical. A cylinder inserted into the receptacle slides by means of the projections extending radially therefrom in the vicinity of the incisions when the helical sections are rotated. The cylinder is thereby displaced axially with regard to the receptacle. This facilitates the removal of the cylinder from the receptacle.

According to a further refinement feature, the receptacle has a first, essentially cylindrical section, a conical section and a second cylindrical section adjoining the latter. Such a design of the receptacle is suitable in particular for holding substances which are to be freeze dried in the receptacle before it is closed.

The conical section of the receptacle is advantageously of a shape which corresponds to a conically designed end of the cylinder in the vicinity of the partition. Particularly good leak-tightness of the container is thereby achieved.

A plurality of grooves running axially can be provided on the inner wall of the receptacle, preferably in the region of the first cylindrical section. The said grooves make it possible for air to enter into the receptacle as the cylinder is being pulled out. The buildup of a negative pressure is thereby counteracted.

Exemplary embodiments of the invention are explained in more detail below. Herein:

DETAILED DESCRIPTION OF THE INVENTION

A first embodiment is represented in FIGS. 1–6.

Figure 1:
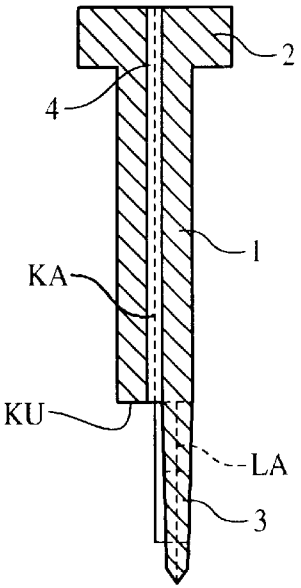
FIG. 1 shows a schematic cross-sectional view of a piston of a first embodiment.

FIG. 1 shows a schematic cross-section through a piston 1 produced from injection molded plastic. A gripping piece is molded onto a piston upper side and a lance 3 onto a piston lower side KU, in an integral design. The lance 3 is attached to the piston lower side KU in a non-concentric arrangement, i.e. the lance axis LA does not correspond with the piston axis KA.

Figure 2:
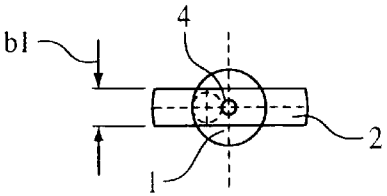
FIG. 2 shows a plan view according to FIG. 1.

As emerges from FIGS. 1 and 2, the gripping piece 2 is of plate-like design. It has a width b1. The piston 1 and the gripping piece 2 are cut through by a passage 4.

Figure 3:
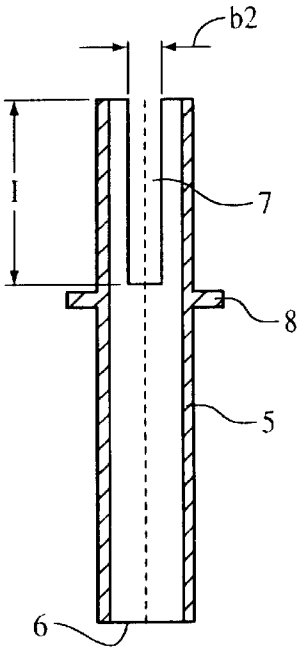
FIG. 3 shows a schematic cross-sectional view of a cylinder of the first embodiment.
Figure 4:
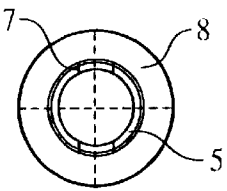
FIG. 4 shows a plan view according to FIG. 3.

FIG. 3 shows a schematic cross-section through a cylinder 5 produced integrally from injection-molded plastic. The cylinder 5 has a closed end which is closed by a partition 6 which can be perforated. Two incisions 7 lying opposite each other and of identical length 1 are provided in the cylinder wall at the opposite, open end. The width b2 of the incisions 7 is larger than the width b1 of the gripping piece 2. A radially encircling, flange like web 8 extends from the outer cylinder wall. The opposing arrangement of the incisions 7 emerges clearly once again from the plan view shown in FIG. 4.

Figure 5:
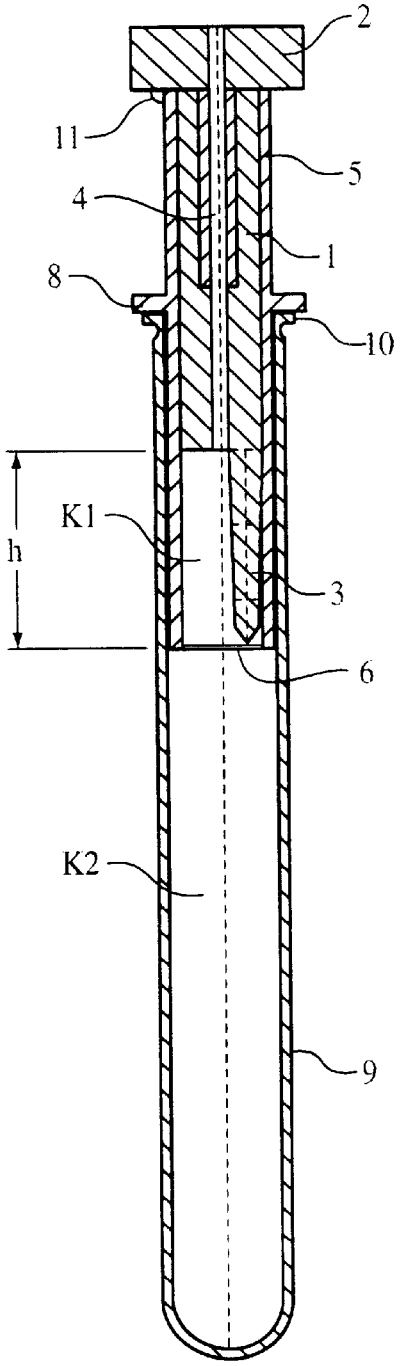
FIG. 5 shows a schematic cross-sectional view of a container having a cap according to the first embodiment, the piston being located in a first position.

FIG. 5 illustrates a container having a cap schematically in cross-section. A receptacle 9 produced from injection-molded plastic is shaped in a similar manner to a test tube. It has an encircling bead 10 on its opening. The cylinder 5 is inserted into the receptacle 9 in such a manner that the web 8 bears against the bead 10.—The web 8 may have a projection (not shown here) which, when the web 8 bears against the bead 10, grips behind the latter, so that the cylinder 5 latches to the receptacle 9.

The piston 1 is inserted into the cylinder 5. The gripping piece 2 has a larger diameter than the cylinder 5. It bears against the upper circumferential edge of the open end of the cylinder 5, specifically at the location in which incisions 7 are not provided. In this first position, the piston 1 cannot be pressed down in the direction of the partition 6. A plastic bridge 11 connects the gripping piece 2 to the cylinder 5. It fixes the gripping piece 2 in a position in which it is not aligned with the incisions 7 and therefore cannot be pressed down. A first chamber K1 having a height h is formed between the piston lower side KU and the partition 6. The receptacle 9 and the partition 6 surround a second chamber K2.

Figure 6:
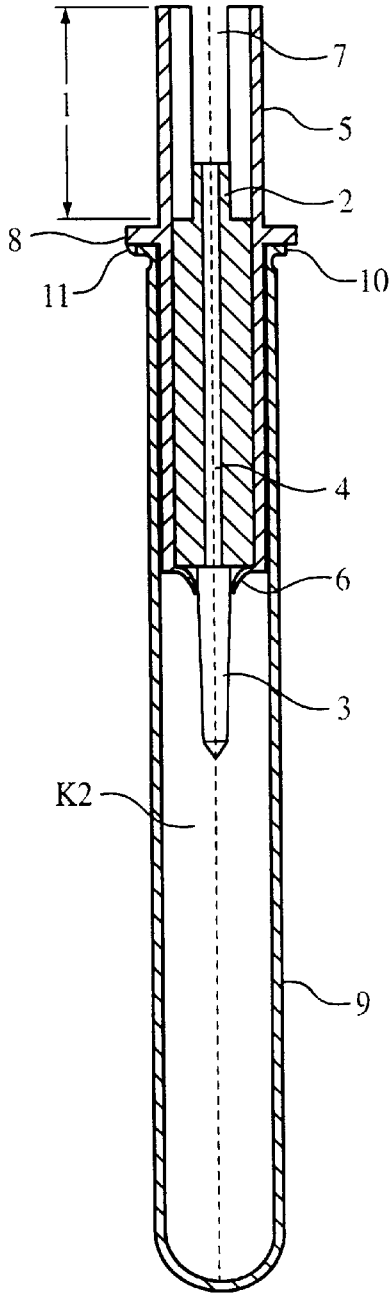
FIG. 6 shows a schematic cross-sectional view according to FIG. 5, the piston being located in a second position.

FIG. 6 shows a cross-sectional view according to FIG. 5, the piston 1 being located in a second, pressed down position. The gripping piece 2 is aligned with the incisions 7. The said gripping piece has been pressed down against the partition 6 by the length 1. The lance 3 pierces the partition 6. The piston lower side KU bears against the pierced partition 6. The volume of the first chamber K1 is completely filled by the piston 1.

Figure 10:
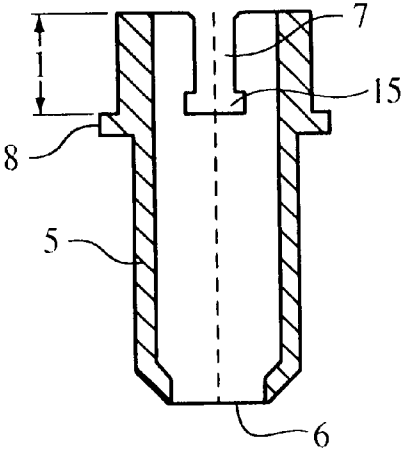
FIG. 10 shows a schematic cross-sectional view of a cylinder of the second embodiment.
Figure 8:
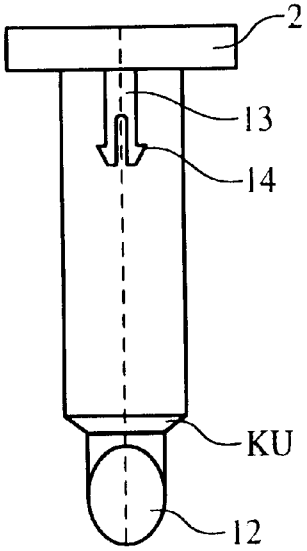
FIG. 8 shows a second side view according to FIG. 7.
Figure 9:
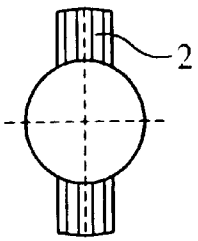
FIG. 9 shows a plan view according to FIG. 8.
Figure 7:
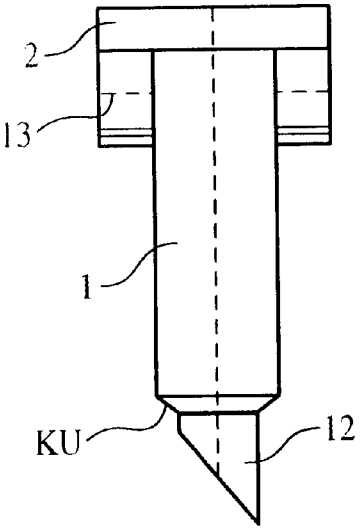
FIG. 7 shows a side view of a piston of a second embodiment.

FIGS. 7–11 show a second embodiment. In this case, a beveled piston section 12 is provided on the piston lower side KU for piercing the partition 6. Two extensions 13, on the ends of which two latching lugs 14 are provided in each case, extend axially from the gripping piece 2 in the direction of the piston lower side KU. The incisions 7 provided on the cylinder 5 shown in FIG. 10 are provided with recesses 15 which can be gripped from behind for engagement of the latching lugs 14.

Figure 11:
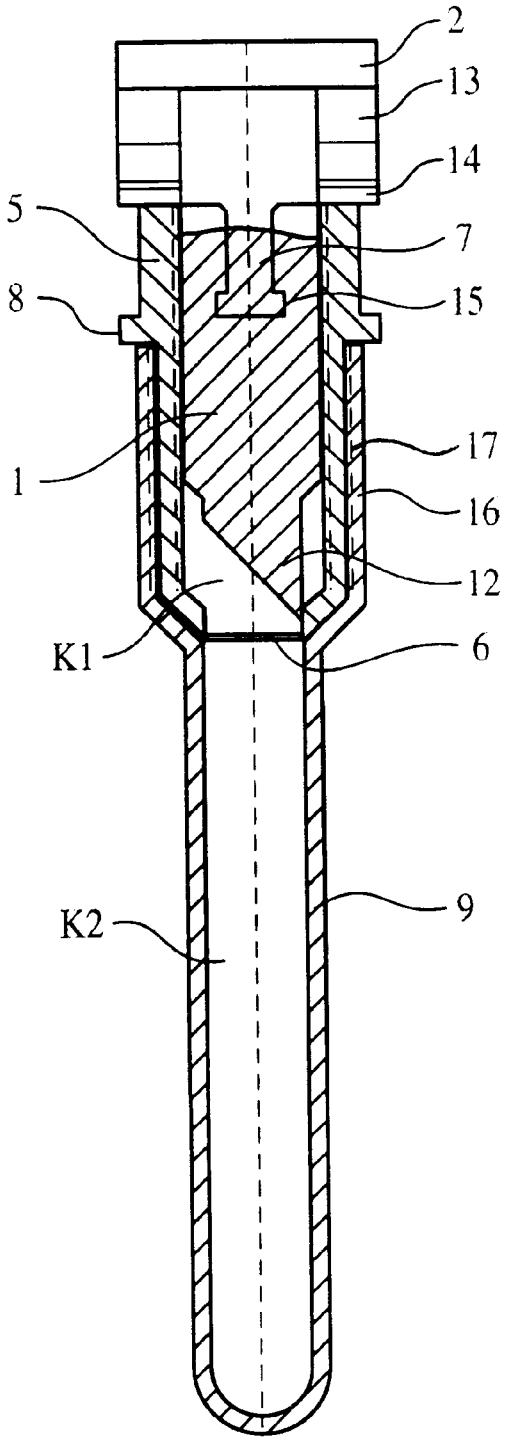
FIG. 11 shows a schematic cross-sectional view of a container according to the second embodiment.
Figure 13:
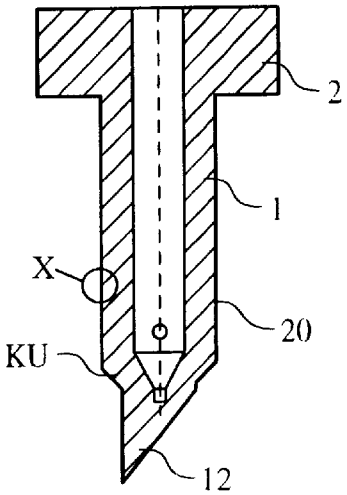
FIG. 13 shows a second cross-sectional view of the piston according to FIG. 12.
Figure 12:
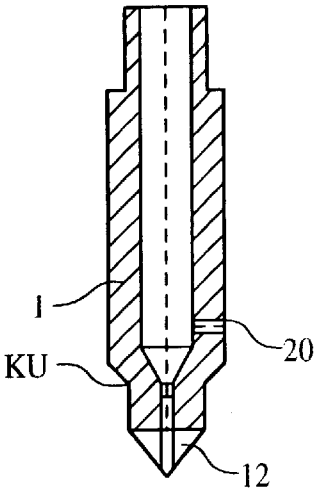
FIG. 12 shows a first cross-sectional view of a piston of a third embodiment.
Figure 14:
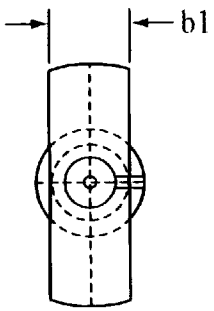
FIG. 14 shows a plan view according to FIG. 12.
Figure 16:
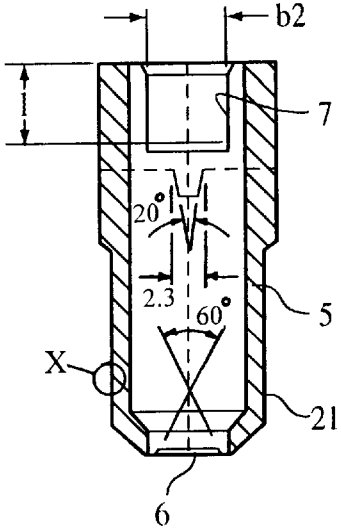
FIG. 16 shows a second cross-sectional view according to FIG. 15.
Figure 15:
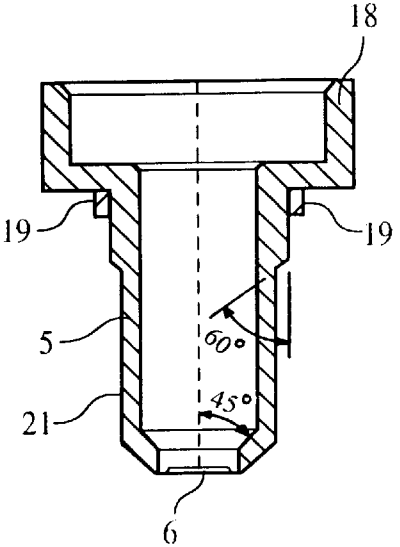
FIG. 15 shows a first cross-sectional view of a cylinder of the third embodiment.
Figure 17:
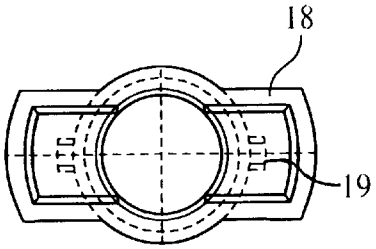
FIG. 17 shows a plan view according to FIG. 15.

FIG. 11 shows a schematic cross-sectional view of the second embodiment. The receptacle 9 has, in the vicinity of its opening, a section 16 having an enlarged diameter. Grooves 17 running axially are provided on the inner wall of the section 16, the said grooves extending from the opening as far as into the vicinity of the end of the section 16.

In the third exemplary embodiment shown in FIGS. 12 to 22, the piston 1 has, on its piston lower side KU, a beveled piston section 12. The piston lower side KU is of conically tapering design. Two first encircling sealing lips are denoted by the reference number 20.

The cylinder 5 has a rectangular holder 18 bounded by an encircling wall. In a suitable position, the gripping piece 2 can be pressed down into the holder 18.

Projections 19 are molded onto the lower side of the holder 18. The shape of the cylinder interior is designed corresponding to the shape of the piston 1, so that with the piston 1 pushed completely into the cylinder, the cylinder interior is completely filled. Encircling, second sealing lips molded onto the outer wall of the cylinder 5 are denoted by 21. Instead of the sealing lips provided here, an O-ring held in a groove can also be provided.

Figure 18:
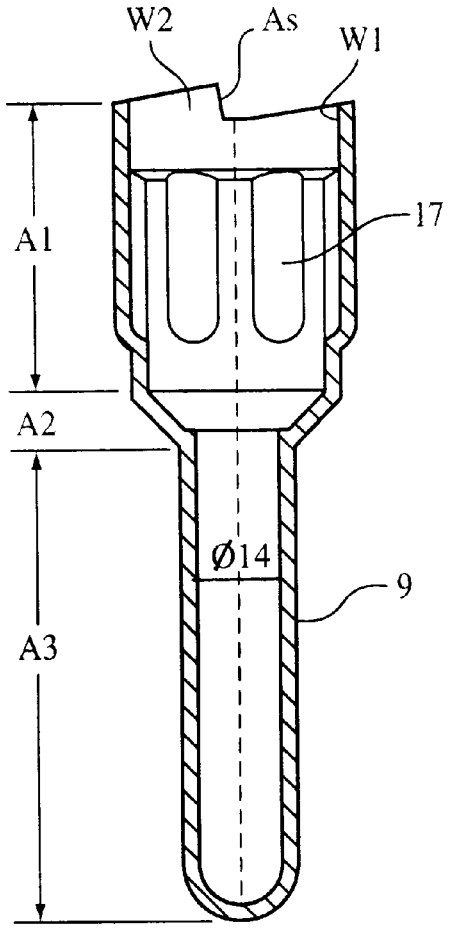
FIG. 18 shows a first cross-sectional view through a receptacle of the third embodiment.
Figure 19:
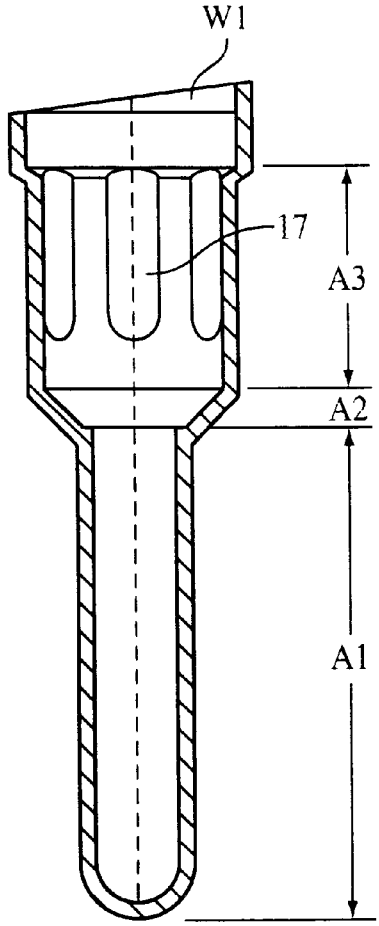
FIG. 19 shows a second cross-sectional view according to FIG. 18.
Figure 20:
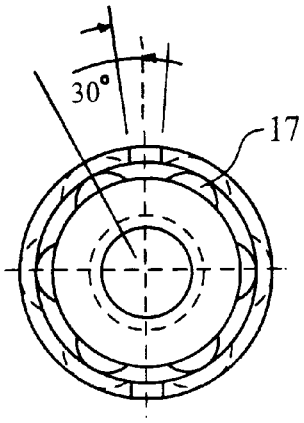
FIG. 20 shows a plan view according to FIG. 18.

The receptacle 9 shown in FIGS. 18 to 20 consists of a first, essentially cylindrical section A1 on whose inner wall grooves 17 running axially are provided. A2 denotes a second, conically tapering section which is adjoined by a second, cylindrical section A3 whose diameter is smaller than that of the first cylindrical section A1. The opening edge of the receptacle 9 is designed in the form of two helical sections W1, W2 which each extend over a circumferential section of approximately 180°. The helical sections W1, W2 are separated by a shoulder As whose height corresponds to half the pitch of a complete helical turn.

Figure 21:
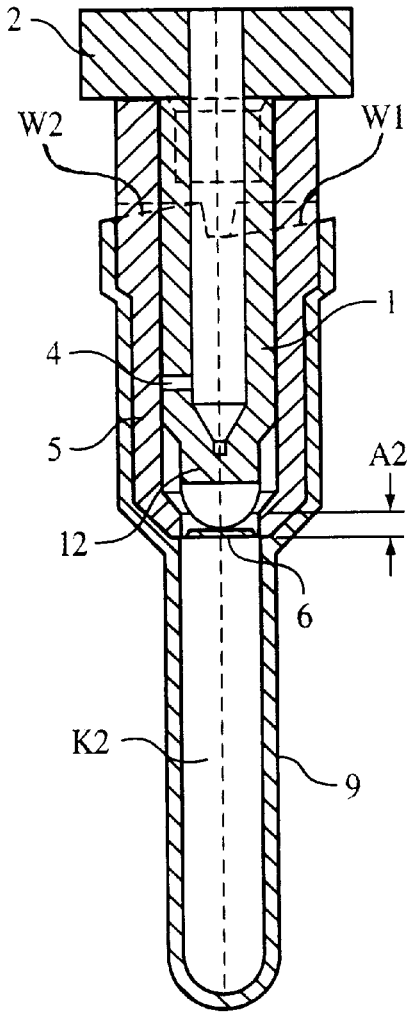
FIG. 21 shows a first cross-sectional view through a container according to the third embodiment.
Figure 22:
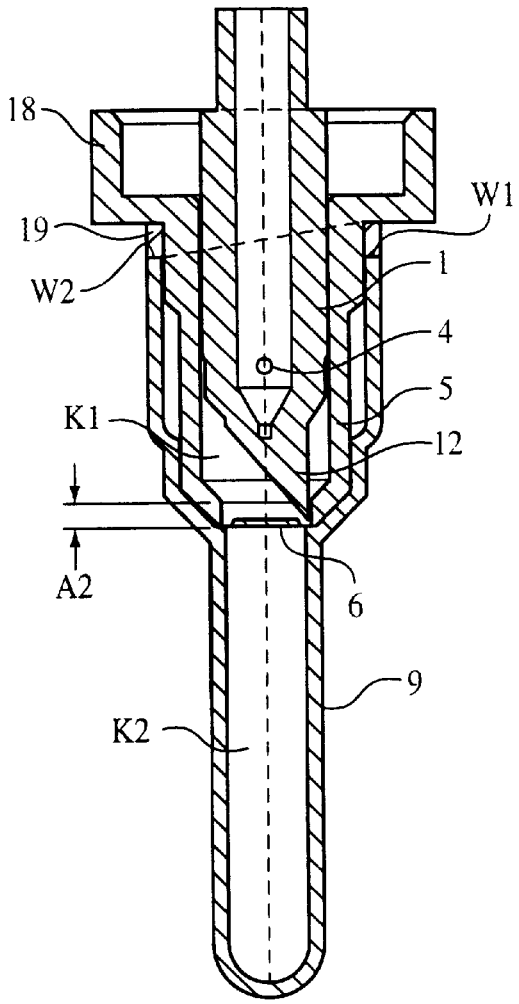
FIG. 22 shows a second cross-sectional view according to FIG. 21.

FIGS. 21 and 22 show the container as a whole. The cylinder 5 bears, by means of its end located in the vicinity of the partition 6, in a positive locking manner against the inner wall of the conical section A2 of the receptacle 9. The projections 19 are seated on the helical sections W1 and W2.

The functioning of the container is as follows:

After the receptacle 9 is filled with a defined quantity, for example 30 $\mu$l of a second component, the cap is placed on. The receptacle 9 is therefore sealed in a leak tight manner.

The first chamber K1 of the cap is filled with a first component, for example through the passage 4. The passage 4 is then closed.—It is equally possible to fill the first chamber K1 before the cap is placed onto the container 9.

In order to produce a mixture consisting of the first and second components, the user rotates the gripping piece 2 about approximately 90°, so that it is aligned with the incisions 7. In the process, the plastic bridge 11 is clearly and perceptively severed. The gripping piece 2 is then pressed down against the partition 6. As this happens, the lance 3 or the piston section 12 pierces the partition 6, and under the action of the piston 1 the first component is pressed completely into the second chamber K2. The mixture formed can be removed from the receptacle 9 by removing the cap.

In the second embodiment, with the piston 1 pressed down completely, the latching lugs 14 grip behind the recesses 15 (not illustrated here). Pulling on the gripping piece 2 therefore enables the piston 1 to be withdrawn together with the cylinder 5 in order to open the container 9.

When the piston 1 has not been completely inserted into the section 16 of the receptacle 9, the grooves 17 form a connection from the second chamber K2 to the environment. Water vapor formed, for example when freeze-drying a component placed into the second chamber K2, can escape from the second chamber K2 through the grooves 17. After the freeze-drying process, the second chamber K2 can be closed in a leak-tight manner by completely pushing the cylinder 5 into the section 16.

In the third exemplary embodiment, the cylinder 5 can be gripped on the holder 18 and rotated in the clockwise direction in order to open the container. The extensions 19 then slide over the helical sections W1, W2. The cylinder 5 is moved axially with respect to the receptacle 9 in the opening direction. This facilitates opening of the container.

LIST OF DESIGNATIONS

1 Piston
2 Gripping piece
3 Lance
4 Passage
5 Cylinder
6 Partition
7 Incision
8 Web
9 Receptacle
10 Bead
11 Plastic bridge
12 Piston section
13 Extensions
14 Latching lugs
15 Recesses
16 Section
17 Groove
18 Holder
19 Projections
20 First sealing lip
21 Second sealing lip
KU Piston lower side
LA Lance axis
KA Piston axis
l Length of the incision
h Height of the first chamber
K1 First chamber
K2 Second chamber
b1 Width of the gripping piece
b2 Width of the incision
A1 First section
A2 Second section
A3 Third section
As Shoulder
W1, W2 Helical section

What is claimed is:

1. A cap for containers for holding a mixture to be produced from two components, having a cylinder (5) with an open end and an end closed by a partition (6) which can be perforated, a piston (1) having a gripping piece (2) of larger design than the cylinder diameter being inserted into the open end of the cylinder, so that a first chamber (K1) having a height (h) is formed between a lower side (KU) of the piston, lying opposite the gripping piece (2) and the partition (6), characterized in that two incisions (7) extending from the open end of the cylinder and lying opposite each other are provided in the cylinder wall, and in that the gripping piece (2) is designed in such a manner that it can be displaced in the incisions (7) in order to move the piston (1) in the direction of the partition (6).

2. The cap according to claim 1, the height (h) being smaller than or equal to a length (l) of the incisions (7).

3. The cap according to claim 1, the gripping piece (2) being of plate like design.

4. The cap according to claim 1, a means for piercing the partition (6) being provided on the piston lower side (KU).

5. The cap according to claim 4, the means for piercing being a lance (3) or a beveled piston section (12).

6. The cap according to claim 1, a radially encircling sealing means, being provided on the piston (1).

7. The cap according to claim 1, the piston (1) and the gripping piece (2) having an axial passage (4).

8. The cap according to claim 1, the piston (1) being produced in an integral design with the gripping piece (2) from injection molded plastic.

9. The cap according to claim 1, the gripping piece (2) and the cylinder (5) being connected to a bridge (11) which can be severed and is preferably produced from plastic.

10. The cap according to claim 1, a radially encircling flange like web (8) being provided on the outer wall of the cylinder (5).

11. The cap according to claim 1, a plurality of grooves (17) being provided on the outer wall of the cylinder (5), the plurality of grooves running axially.

12. The cap according to claim 1, the piston having extensions (13), the extensions having latching lugs (14) for engagement in recesses (15) of the container, the recesses being provided on the incisions (7) attached to the gripping piece (2).

13. The cap according to claim 1, the cylinder (5) having a radially extending projection on the outer wall in the vicinity of each incision (7).

14. A container having a cap according to claim 1, the container having a receptacle (9) of essentially cylindrical design, and the cap being inserted in a sealing manner into the receptacle (9), with the result that the partition (6) closes a second chamber (K2) formed in the receptacle (9).

15. The container according to claim 14, the opening edge of the receptacle (9) being designed in the form of two helical sections (W1, W2) placed against each other in each case by a shoulder (As).

16. The container according to claim 14, the receptacle (9) having a first, essentially cylindrical section (A1), a conical section (A2) and a second cylindrical section (A3) adjoining the latter.

17. The container according to claim 16, the conical section (A2) of the receptacle (9) being of a shape which corresponds to a conically designed end of the cylinder (5) in the vicinity of the partition (6).

18. The container according to claim 17, a plurality of grooves (17) running axially being provided on the inner wall of the receptacle (9), preferably in the region of the first cylindrical section (A1).

19. The cap of claim 6, the radially encircling sealing means being a sealing lip (20) or an O-ring.

* * * * *

UNITED STATES PATENT AND TRADEMARK OFFICE

CERTIFICATE OF CORRECTION

PATENT NO. : 6,364,104 B1 
DATED : April 2, 2002
INVENTOR(S) : Wolf Bertling and Werner Frör It is certified that error appears in the above-identified patent and that said Letters Patent is hereby corrected as shown below:

Title page,
Item [56], References Cited, FOREIGN PATENT DOCUMENTS, please insert the following:

| | | |
|---|---|---|
| -- DE | 2 709 826 | 11/1977 |
| EP | 0 217 425 | 04/1987 |
| CH | 485,566 | 3/1970 -- |

Signed and Sealed this

Seventeenth Day of February, 2004

JON W. DUDAS
*Acting Director of the United States Patent and Trademark Office*